US006584372B1

(12) United States Patent
Murphy

(10) Patent No.: US 6,584,372 B1
(45) Date of Patent: Jun. 24, 2003

(54) DYE RATE CONTROL FOR PAPER WEB COLOR CHANGE

(75) Inventor: Timothy F. Murphy, Columbus, OH (US)

(73) Assignee: ABB Automation Inc., Columbus, OH (US)

( * ) Notice: Subject to any disclaimer, the term of this patent is extended or adjusted under 35 U.S.C. 154(b) by 0 days.

(21) Appl. No.: 09/572,640

(22) Filed: May 17, 2000

(51) Int. Cl.[7] ..... G06F 7/66
(52) U.S. Cl. ..... 700/128; 356/402
(58) Field of Search ..... 700/128, 127, 700/122–123, 129; 356/402, 408, 409, 411, 419, 425

(56) References Cited

U.S. PATENT DOCUMENTS

| | | | | | |
|---|---|---|---|---|---|
| 1,981,803 | A | | 11/1934 | Hedstrom, Jr. | 162/134 |
| 4,439,038 | A | * | 3/1984 | Mactaggart | 356/408 |
| 4,543,157 | A | | 9/1985 | Jones et al. | 162/134 |
| 4,813,000 | A | * | 3/1989 | Wyman et al. | 382/165 |
| 5,082,529 | A | | 1/1992 | Burk | 162/198 |
| 5,131,910 | A | | 7/1992 | Breault | 8/400 |
| 5,793,486 | A | | 8/1998 | Gordon et al. | 356/328 |
| 6,024,018 | A | * | 2/2000 | Darel et al. | 101/365 |
| 6,041,708 | A | * | 3/2000 | Kipphan et al. | 101/365 |
| 6,052,194 | A | | 4/2000 | Nuyan | 356/402 |
| 6,343,240 | B1 | * | 1/2002 | Shakespeare et al. | 700/129 |
| 6,421,575 | B1 | * | 7/2002 | Shakespeare | 700/127 |

FOREIGN PATENT DOCUMENTS

EP 0 421 172 A1 4/1991

OTHER PUBLICATIONS

Raymond P. Shead, et al., "Next Generation Colour Change Control: Its Strategy and Results," Paper Technology, pp. 24–32, vol. 41, No. 5, 2000.

Radwan A. Masmoudi, "Improved color and pH control using adaptive deadtime compensation," TAPPI Journal (Jul. 1999), pp. 124–132.

Shih–Chin Chen, et al., "A Color Measurement and Control System for Paper–Making Processes", Proceedings of the 1996 IEEE International Conference on Control Applications, Sep. 15–18, 1996, pp. 136–142.

John Shakespeare, et al., "An optimizing color controller," TAPPI Journal, vol. 81, No. 9, pp. 171–179.

* cited by examiner

*Primary Examiner*—Leo Picard
*Assistant Examiner*—Zoila Cabrera
(74) *Attorney, Agent, or Firm*—Stevens & Showalter, LLP

(57) ABSTRACT

For a web color change, at least one current dye rate is determined and at least one nominal dye rate for the new web color is retrieved. The difference between the current dye rate and the nominal dye rate is used in a dye rate change response to change the dye rate thereby changing the web color from a first to a second color. The dry rate change response is boosted to achieve a faster rate of color change. Dye rates required for color targets are determined by accumulating historical data of production dye rates that are combined with current dye rate data to arrive at new nominal dye rates for web colors to be produced. A retrieved nominal dye rate and the current dye rate are combined using a filter factor, $\alpha$, ($0 \leqq \alpha \leqq 1$), defining the fraction of the historical dye rate which is combined with the remaining fraction of the active dye rate to determine a new nominal dye rate stored as the nominal dye rate for the given product color. The current dye rate is preferably taken near the beginning of a run of a given color; however, it can be taken at any point in the run and can be an accumulation of data which is averaged to determine the active dye rate used to determine the new nominal dye rate to be stored for a given web color.

20 Claims, 3 Drawing Sheets

DYE RATE CONTROL FOR PAPER WEB COLOR CHANGE

BACKGROUND OF THE INVENTION

The present invention relates in general to paper making machines which manufacture webs of paper and, more particularly, to color changes of the web of paper being manufactured through dye rate control.

Tinting or coloring paper by the use of colorants, referred to herein generically as "dyes," to establish a final product color has been common for many years in the operation of paper making machines 100, see FIG. 1. The actual sheet or web color is determined by measuring the reflectance spectrum of the web as it travels through the production process. For example, measurement may be performed by an online spectrometer 101 that measures the reflectance spectrum of the web with measurements normally taking place near the end of the process at a point where the product is nearly complete 102. Dye additions can be made at different stages of the paper making process to achieve a desired color shade. To make a very deep shade of color, dye can be added to a blend chest 104 as part of the base load to allow for a higher concentration of dye on the paper fibers. This is referred to as base loading. Dyes can also be added almost anywhere before the inlet to the fan pump 106 for fine adjustments or compensating color disturbances. This is referred to as color trimming. While the paper is forming on a Fourdrinier wire 108, colorants can be applied on a felt side 108A and/or a wire side 108B of the paper. Colorants can also be added at a size press 110 or in coating materials. The distances between the dye addition points and the color sensor vary dependent upon the points of dye addition. The delay times are also dependent upon characteristics of the device used to add the dye with times commonly being on the order of up to several minutes, several magnitudes greater than the process time constant.

The paper making machine continues to operate while color changes are being made so that the web of sheet material produced during a color change does not meet the specifications for either the original color paper being made or the new color paper to which the process is being changed. This out-of-spec web, referred to as color broke, is recycled back to the early stages of production. Since color broke and its recycling are very costly, reductions in color change times will reduce, possibly substantially reduce, production costs of colored papers.

Automatic control is widely used during normal production to maintain desired color targets. Multiple dyes with complementing characteristics are regulated under automatic control to achieve final product color targets within specification limits. During product color or shade changes an operator can manually make changes to each dye flow actuator until the new product specifications are met. Because of the long delay from the dye addition to the color sensor and a large time lag due to recirculation of the basis product and water 112 at the initial forming section of the paper making machine, color changes can take quite a long time to complete. Color change times of 40 minutes to over 60 minutes are very common when performed manually by production operators.

A method and apparatus for controlling the spectral reflectance of a material such as a paper web is disclosed in U.S. Pat. No. 6,052,194. In the '194 patent, a comparison is performed between target reflectance values and measured reflectance values in numerous wavelength bands spanning the visible spectrum. The comparison quantifies errors that are modified by a nonlinear operation, such as squaring, and then added together. The resulting sum is minimized by individually adjusting the application of a number of colorants to the web process. The number of wavelength bands is made greater than the number of colorants to avoid metameric effects.

While the '194 patent illustrates one color change technique, other color change arrangements are needed to provide alternatives and to advance the state of the art. Preferably, such an arrangement would not only reduce the time required to make color changes but also enable improved determinations of dye rates required for given color targets of the paper to be produced by a paper making machine.

SUMMARY OF THE INVENTION

The present invention currently meets this need by providing methods and apparatus for making improved web color changes in a paper making machine. In accordance with the present invention, when a web color change is to be made, at least one current dye rate (normally a plurality of dye rates) is determined and a nominal dye rate (or a corresponding plurality of nominal dye rates) representative of the new web color is retrieved from storage. The difference between the current dye rate and the retrieved nominal dye rate, Δdyerate, is used in a dye rate trajectory or change response defined by the equation:

$$ChgDyeRate(s) = \left\{\left[\frac{\tau_1}{\tau_2} - \left(\frac{\tau_1}{\tau_2} - 1\right)\frac{e^{-T_{d2}s}}{\tau_2 s + 1}\right]e^{-T_{d1}s}(\Delta dyerate)\right\}u(s)$$

to change the dye rate thereby changing the web color from a first color to a second color. Improved determinations of color targets or nominal dye rates are made by accumulating historical data representative of production dye rates from past process production for corresponding product colors and combining the historical data with current dye rate data to arrive at new nominal dye rates for colors of web to be produced by the paper making machine. A retrieved nominal dye rate and the current or active dye rate are combined using a filter factor alpha (α). The filter factor α, which is greater than or equal to zero and less than or equal to one ($0 \leqq \alpha \leqq 1$), determines the fraction of the historical dye rate which is combined with the remaining fraction of the active dye rate to determine the new nominal dye rate that is stored as the nominal dye rate for the given product color as shown in the equation:

NewNominalDyerate=(α)SavedNominalDyerate+(1−α)ActiveDyerate.

The active dye rate is preferably taken near the beginning of a run of a given color; however, it can be taken at any point in the run and can be an accumulation of data which is averaged to arrive at the active dye rate used for the determination of the new nominal dye rate to be stored for a given web color.

The invention of the present application will be better understood from the following description, the accompanying drawings and the appended claims.

DETAILED DESCIPTION OF THE INVENTION

The present invention will now be described as it relates to web color changes through colorant or dye rate control for paper making machines and, more particularly, to a novel dye addition change or trajectory response that reduces the time it takes to achieve a web color change. Another aspect of the invention enables improved determinations of nominal dye rates to more quickly achieve color targets for paper to be produced by paper making machines. The invention applies to paper making machines that produce colored paper webs by the use of colorant additives, referred to herein generically as "dyes," to achieve a final web color.

Figure 1:
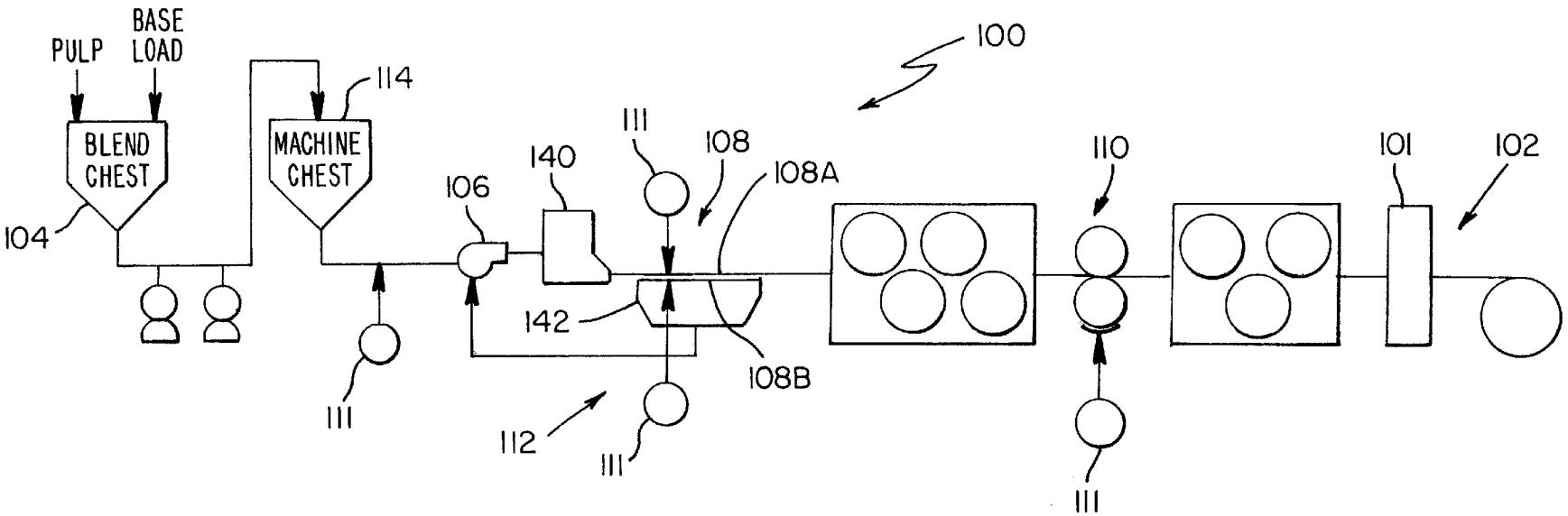
FIG. 1 is a schematic side view of a paper making machine operable in accordance with the present invention.

The color of a web of paper being produced is made to correspond to required color specifications by controlling the flow of dye, or more commonly the flows of a plurality of dyes, which is added to the process at one location, or a plurality of locations, along the process. For example, dye can be added at the blend chest 104 and almost anywhere before the inlet to the fan pump 106, on the felt side 108A and/or the wire side 108B of the paper at the Fourdrinier wire 108 and at the size press 110 or in coating materials, see FIG. 1. The flow is added to the process using metering pumps 111 that deliver the dye in a diluted form to the process as a volumetric flow. For proper product color control, the dye flow is normalized to the product production rate and is referred to as "dye rate" which is defined by the following equation:

$$DyeRate_i = \frac{(PumpHeadsize_i)(ShaftSpeed_j)(DyeConcentration_i)(DyeDensity_i)(UnitConv)}{ProductionRate}$$

where

- $DyeRate_i$=Normalized dye rate (mass of dye per mass of fiber)
- $PumpHeadsize_i$=Dye pump volumetric capacity (volume)
- $ShaftSpeed_j$=Pump shaft speed (revolutions per time)
- $DyeConcentration_i$=Dye concentration (percent of full strength)
- $DyeDensity_i$=Dye density (mass per volume)
- UnitConv=Unit conversion for dye mass flow
- ProductionRate=Rate of paper fiber production (mass of fiber per time)
- i=Dye index 1 through m
- j=Shaft speed 1 through n The normalized dye rate is used to achieve consistent color control under changing process conditions and also is the basis for the novel dye rate change response aspect of the present invention.

A nominal dye rate is estimated for each product color by accumulating historical data representative of production dye rates from past process production for corresponding product colors. The current or active dye rate for a web of paper being manufactured corresponds generally to the current or active color target for a first color so that the paper web satisfies required color specifications for the first color. However, after a web color has been run for a period of time, normally occurring disruptions and changes in the process lead to changes in the dye rate to maintain web color within required specifications, i.e., over time the dye rate is varied to compensate for process disruptions and changes. When the paper machine color target is significantly changed to a second color due to a web color or shade change, the nominal dye rate for the second color is retrieved and compared to the current dye rate for the first color.

The difference between the nominal dye rate for the second color and the current dye rate for the first color, Δdyerate, is used in the dye rate change trajectory response as will be described hereafter. When the web has changed from the first color to the second color, i.e., the web color has achieved the specifications required for the second color within acceptable tolerance limits, the current active dye rate is saved to a historical database by combining the current historical dye rate or retrieved nominal dye rate and the active dye rate with the use of a filter factor alpha (α). The filter factor alpha, which is greater than or equal to zero and less than or equal to one ($0 \leqq \alpha \leqq 1$), determines the fraction of the historical dye rate which is combined with the remaining fraction of the active dye rate to determine the new nominal dye rate that is stored as the nominal dye rate for the given product color. The resulting new nominal dye rate thus provides an estimate of the dye rate based on the historical production of the color and is used when the web is changed from one color to the given color.

$$NewNominalDyerate=(\alpha)SavedNominalDyerate+(1-\alpha)ActiveDyerate \quad \text{(equation 2)}$$

When a product color is produced for the first time, the value of α is set to 0.0 in order to save the entire active dye rate as the new nominal dye rate and thereby start the historical data for the color. Otherwise, the value of α can set at a selected value, for example in a range from about 0.2 to about 0.3, or it can be dynamically determined based on the quality of the web of paper currently being manufactured and performance parameters of the paper making machine. A value of α close to 0.0 corresponds to production of high quality paper and a properly operating paper making machine, while a value of α close to 1.0 corresponds to the production of lower quality paper and a paper making machine that is or has been experiencing problems. For example, the following conditions represent factors which may be considered and can be aggregated to form the final value of α to use when the nominal dye rate is updated, i.e., $\alpha=\alpha_1+\alpha_2+\alpha_3+\alpha_4+\alpha_5$. If the conditions do not exist, then the corresponding $\alpha_x$ components are set equal to zero. Other machine conditions and/or paper characteristics can be used in the present invention in place of or in addition to these exemplary performance parameters.

| Performance parameter | α component |
|---|---|
| If sheet break has recently occurred | $\alpha_1 = 0.1$ |
| If paper broke (reject) recirculation color variability is high | $\alpha_2 = 0.2$ |
| If color specification error variability is high | $\alpha_3 = 0.1$ |
| If moisture content does not meet active target | $\alpha_4 = 0.3$ |
| If machine wet-end pH does not meet active target | $\alpha_5 = 0.3$ |

It is currently believed that the new nominal dye rate which is to be stored as the nominal dye rate for each color should be based on the current active dye rate when the paper making machine has achieved a color change to that color as described above. This can be based on data obtained as soon as the web satisfies the color specifications requirements for the new color, as is currently preferred, or after data is accumulated for a limited period of time and averaged. The use of dye rate data taken early in the production of a web of a given color is believed to be preferable since this data is more representative of the dynamics of the paper making machine at color change than is dye rate data which is collected later in an ongoing run of a web of the given color, for example when the color is to be changed again, since the dye rate at these later times in a run has been adjusted over the run to accommodate disruptions and changes in the process which naturally occur over the run. However, the current invention is not limited to the use of dye rate data collected at the beginning of a run and can be applied to data collected at anytime during the run.

For a color change on a paper making machine, the current or active dye rate is compared to the new product nominal dye rate which is retrieved to serve as an estimate of the dye rate required to produce the new paper web color. This change in dye rate, Δdyerate, is used as an input to the dye rate trajectory or change response of the present invention. The dye rate change response is added to the active dye rate when the color product change is requested. It is noted that the dye rate change response is applicable to all color changes whether the current dye is the same color (reflectance characteristic) as the dye required for the color to which the change is being made or not. In either instance, the response is added to the existing dye rate. In instances when the dye is the same for the old color and the new color, use of the active dye rate is intuitively appealing. However, even in instances when the dye for the new color is not used for the old color, change from the active dye rate for a similar color is still beneficial and is used in the present application. Of course, a current dye rate of zero is also possible in some instances such as initial startup or when a color change is made from a non-colored web. The dye rate change response is defined by the following step response equation:

$$ChgDyeRate(s) = \left\{\left[\frac{\tau_1}{\tau_2} - \left(\frac{\tau_1}{\tau_2} - 1\right)\frac{e^{-T_{d2}s}}{\tau_2 s + 1}\right]e^{-T_{d1}s}(\Delta dyerate)\right\}u(s) \quad \text{(equation 3)}$$

Figure 2:
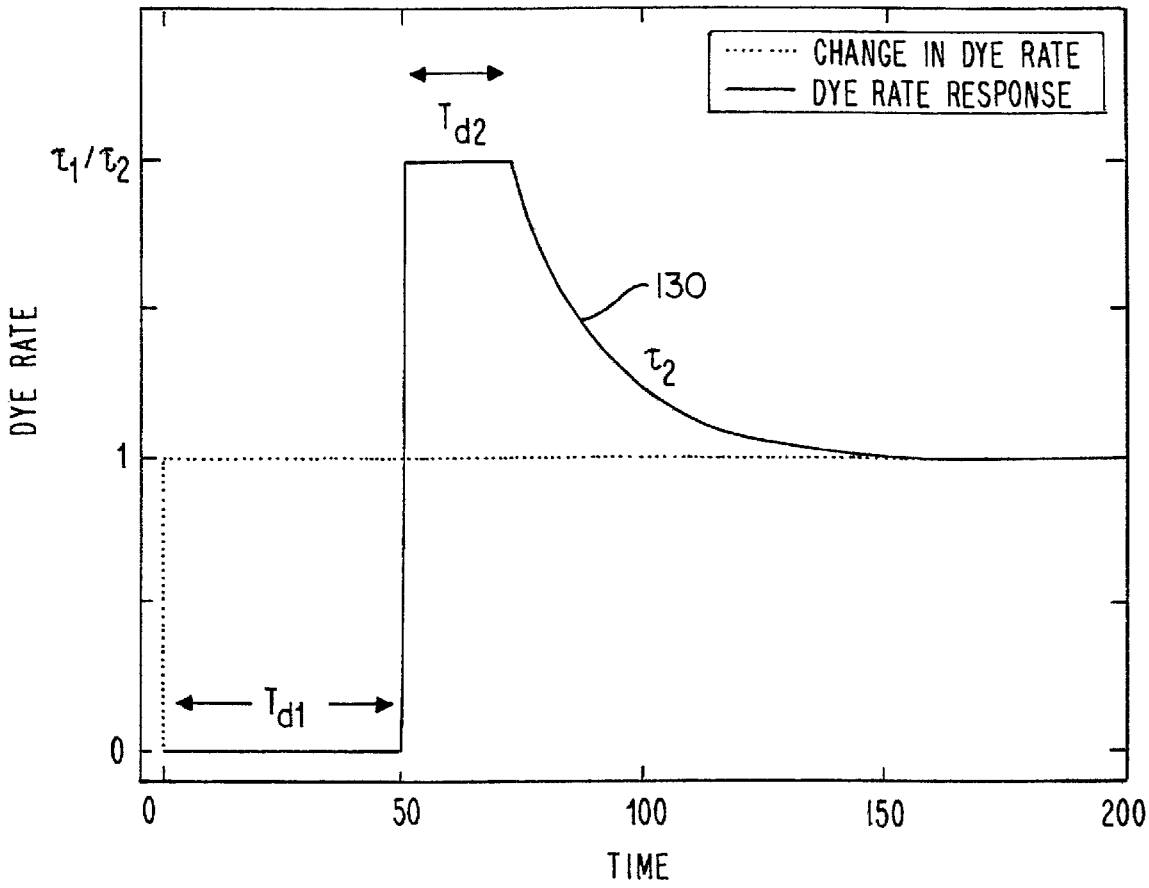
FIG. 2 is a graphical representation of the dye rate change response in accordance with the present invention.

The dye rate change response is similar to a lead/lag ($\tau_1/\tau_2$) response which is given in equation 4. The dye rate change response varies from a traditional lead/lag response in that a first delay time ($T_{d1}$) is added to the initial step response and a second delay time ($T_{d2}$) is added to the filtered response ($\tau_1$) before the dye rate settles back to its final steady state value. An example of a dye rate change response 130 is shown in FIG. 2. It is noted that the dye rate change response 130 is for an increase in the dye rate. It should be apparent that a similar response reflected aroung the x-axis, i.e., a downward step in the dye rate, is used for a decrease in the dye rate.

$$y(s) = \left[\frac{\tau_1 s + 1}{\tau_2 s + 1}\right]u(s) \quad \text{(equation 4)}$$

Figure 3:
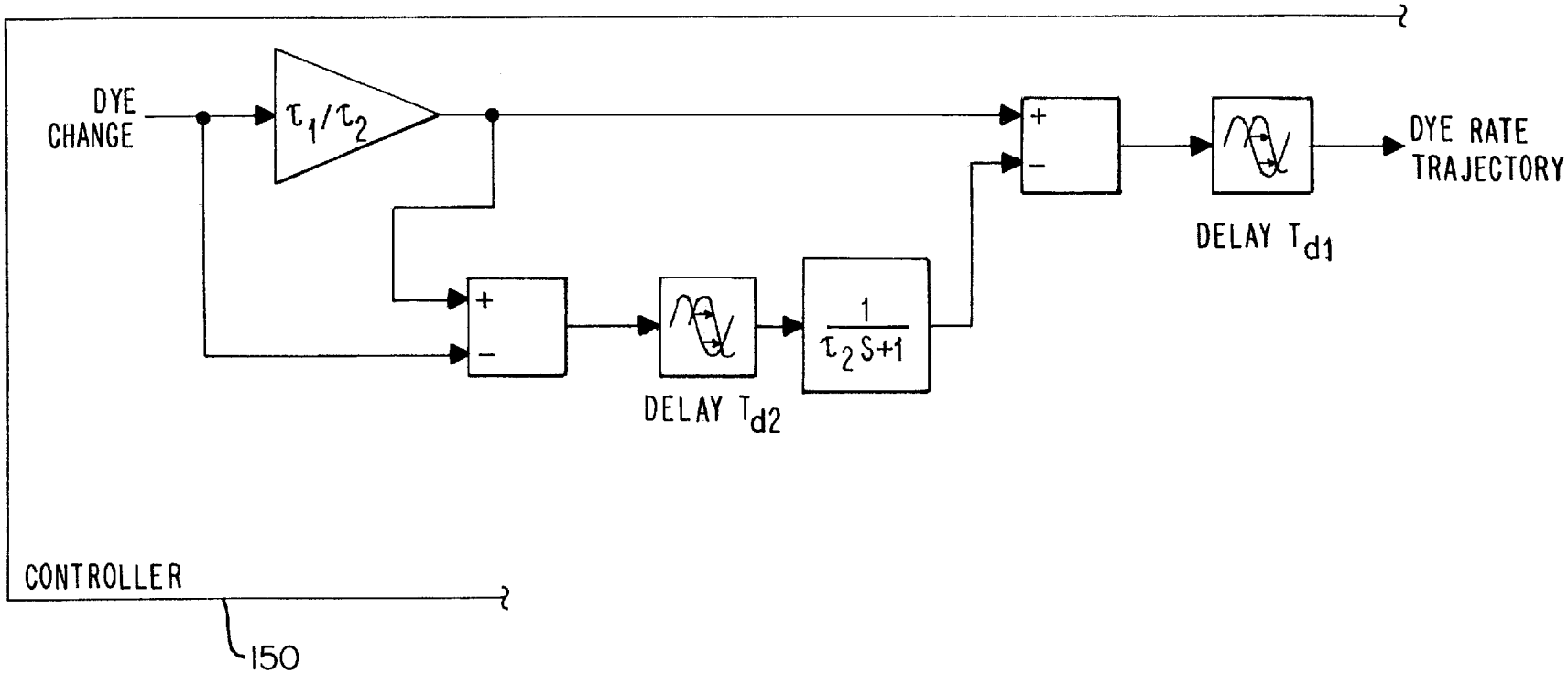
FIG. 3 is block diagram for generation of the new dye rate change response in accordance with the present invention.

A block diagram for generation of the new dye rate change response is shown in FIG. 3 and is implemented within a controller 150. The controller 150 preferably is the controller for the paper making machine 100 but can also be a separate controller coupled to the controller for the paper making machine 100. The block diagram of FIG. 3 illustrates an implementation of the dye rate change response for one dye and is duplicated for multiple dyes in an actual practical implementation, as will be apparent to those skilled in the art. For multiple dyes, the parameters $\tau_1$, $\tau_2$, $T_{d1}$, and $T_{d2}$ can be uniquely selected for each dye to achieve a desired response.

The time delay $T_{d1}$ is used to coordinate the dye rate change for each dye to ensure that the initial effects of all dye rate changes reach the color sensing measurement at substantially the same time. This coordination is needed because a plurality of dyes may be added at different physical locations along the process. Typical dye addition points include the machine chest 114, the fan pump 106, the felt side 108A or the wire side 108B of Fourdrinier wire or the size press 110. Typical values for $T_{d1}$ are on the order of from about 1 minute to about 2 minutes for coordination of the fan pump 106 and the size press 110 dye addition points. If all of the dyes are added at the same addition point, $T_{d1}$ is set equal to zero.

Depending on the dynamic response of each machine, the actual dye rate changes may be driven beyond the values specified by the retrieved nominal dye rates for a period of time before they settle back to the desired steady state values. This over driving of the dye rates is referred to as "boosting" and brings the web to the new color faster than would otherwise occur. It should be apparent that boosting results in a positive over driving for dye rate increases and a negative over driving for dye rate decreases. The ratio of t1 to t2, t1/t2, determines the magnitude of this dye rate boosting action and this ratio will be normally be greater than one, i.e., to provide a boost rather than a retardation. Thus, $$\frac{\tau_1}{\tau_2} \geq 1 \quad \text{(equation 5)}$$

Time constant $\tau_1$ is the response time from a change in the dye rate to about 63% of the resulting final web color change. The time constant $\tau_1$ is determined by means of a dye rate bump test on the paper machine 100 while other paper machine controls and paper sheet properites are held constant. Typical values for the time constant $\tau_1$ are in the range of from about 60 seconds to about 120 seconds. Time constant $\tau_2$ is the desired response time to achieve about 63% of a final web color change. The value of $\tau_2$ should be less than $\tau_1$ to achieve a faster rate of change than what would be achieved by a unity dye rate step change. Typical values for $\tau_2$ for a dye rate increase are in the range of from about 30 seconds to about 60 seconds.

Time delay $T_{d2}$ defines the period of time for which the boosting action is held before the dye rate is allowed to settle back to the final steady state dye rate for the color change. The time delay $T_{d2}$ is set to correspond to the time it takes for the dye to recirculate from the fan pump 106, a headbox 140, and a wire drainage reservoir 142 back to the fan pump 106. The time delay $T_{d2}$ can be dynamically calculated based on the wet end recirculation volume $V_c$ divided by the current fan pump volumetric flow rate $F_w$, see equation 6. Typical values for the time delay $T_{d2}$ are from about 10 seconds to about 20 seconds for machine chest or fan pump dye addition points and zero for size press dye addition.

$$T_{d2} = \frac{V_c}{F_w} \quad \text{(equation 6)}$$

The delay time $T_{d1}$ is used to compensate for dye addition points that are at different physical locations along the process. The delay times $T_{d1}$ for dye addition points closest to the color sensor are greater than the delay time $T_{d1}$ for dye addition points that are further away from the color sensor. This coordination prevents the problem commonly encountered in color changes manually performed by an operator where the effects of the different dye changes do not reach the color sensor at the same time and thus can be misleading in determining the final steady state product color.

The dye rate change response actions defined by the ratio of $\tau_1$ divided by $\tau_2$, $\tau_1/\tau_2$, and the time delay $T_{d2}$ are used to overcome the large recirculation volume of base product, water and the added color dye. When a product color change is made, the new dye rate change response of the present invention decreases the time it takes to reach steady state conditions for the final product color. The ratio of $\tau_1$ divided by $\tau_2$, $\tau_1/\tau_2$, defines the initial gain applied to the original dye rate change and $\tau_2$ can be adjusted to meet the color change time requirements. The delay time $T_{d2}$ can be set to hold the boosted dye rate change for a set time period, which is related to the total paper machine wet-end recirculation volume.

The dye rate change response of the present invention is applicable for example: to any colored flat sheet process; to instances where a dye addition point is separated from the color measurement sensor by a significant time delay; to instances where multiple dye addition points exist and may also be located at different physical locations along the process; and, to a flat sheet forming section (wet-end) including a large recirculation volume which inhibits quick changes in product color of any significant magnitude.

Having thus described the invention of the present application in detail and by reference to preferred embodiments thereof, it will be apparent that modifications and variations are possible without departing from the scope of the invention defined in the appended claims.

What is claimed is:

1. A method for changing color of a web of paper from a first color to a second color during manufacture of said web, said method comprising the steps of:

operating a paper making machine to produce a web of paper having said first color;

determining a current dye rate for at least one dye during production of said web having said first color;

retrieving a nominal dye rate for at least one dye for producing said web having said second color;

determining a dye rate boost value greater than said nominal dye rate for a dye rate increase and less than said nominal dye rate for a dye rate decrease;

determining a period of time of initially applying said dye rate boost;

determining a difference between said current dye rate and said nominal dye rate; and using said difference between said current dye rate and said nominal dye rate to change the dye rate for said at least one dye for said second color from said current dye rate to said nominal dye rate to change said web from said first color to said second color and initially applying said dye rate boost value for said dye rate boost period of time.

2. A method as claimed in claim 1 wherein said at least one dye for which the current dye rate is determined during production of said web having said first color and said at least one dye for producing said web having said second color are the same dye.

3. A method as claimed in claim 1 wherein a plurality of dyes are used, said at least one dye for which the current dye rate is determined during production of said web having said first color being used to produce said web having said first color and:

said step of determining a current dye rate comprises the step of determining a current dye rate for each of said plurality of dyes for said first color;

said step of retrieving a nominal dye rate comprises the step of retrieving a nominal dye rate for each of said plurality of dyes for said second color;

said step of determining a dye rate boost value greater than said nominal dye rate for a dye rate increase and less than said nominal dye rate for a dye rate decrease comprises the step of determining a dye rate boost value for each of said plurality of dyes for said second color;

said step of determining a period of time for initially applying said dye rate boost comprises the step of determining a period of time for initially applying said dye rate boost for each of said plurality of dyes for said second color;

said step of determining the difference between said current dye rate and said nominal dye rate comprises the step of determining differences between said current dye rates and said nominal dye rates for said second color; and said step of using said difference to change the dye rate from said current dye rate to said nominal dye rate comprises the step of using said differences between said current dye rates and said nominal dye rates for said second color to change said web from said first color to said second color and initially applying said dye rate boost values for said plurality of dye rate boost periods of time.

4. A method for changing color of a web of paper from a first color to a second color during manufacture of said web, said method comprising the steps of:

operating a paper making machine to produce a web of paper having said first color;

determining a current dye rate for at least one dye during production of said web having said first color;

retrieving a nominal dye rate for at least one dye for producing said web having said second color;

determining a difference between said current dye rate and said nominal dye rate;

using said difference between said current dye rate and said nominal dye rate to change the dye rate for said at least one dye for said second color from said current dye rate to said nominal dye rate to change said web from said first color to said second color, wherein said at least one dye for which the current dye rate is determined during production of said web having said first color being used to produce said web having said first color and said method further comprises the steps of:

retrieving a nominal dye rate for said at least one dye used for said first color;

combining said nominal dye rate for said at least one dye used for said first color with said current dye rate for said at least one dye for said first color to determine a new nominal dye rate for said at least one dye used for said first color; and saving said new nominal dye rate as said nominal dye rate for said at least one dye being used to produce said web having said first color.

5. A method as claimed in claim 4 wherein said step of combining said nominal dye rate for said at least one dye with said current dye rate for said at least one dye to determine a new nominal dye rate comprises the step of solving the equation:

$$\text{new nominal dye rate}=(\alpha)\text{nominal dye rate}+(1-\alpha)\text{current dye rate},$$

where $0 \leqq \alpha \leqq 1$.

6. A method as claimed in claim 5 wherein $\alpha$ is set equal to a selected value.

7. A method as claimed in claim 6 wherein said selected value is set within a range from about 0.2 to about 0.3.

8. A method as claimed in claim 5 wherein $\alpha$ is calculated based on quality of said web having said first color and performance parameters of said paper making machine.

9. A method for changing color of web of paper from a first color to a second color during manufacture of said web, said method comprising the steps of:

operating a paper making machine to produce a web of paper having said first color;

determining a current dye rate for at least one dye during production of said web having said first color;

retrieving a nominal dye rate for at least one dye for producing said web having said second color;

determining a difference between said current dye rate and said nominal dye rate;

using said difference between said current dye rate and said nominal dye rate to change the dye rate for said at least one dye for said second color from said current dye rate to said nominal dye rate to change said web from said first color to said second color, wherein after said web changes from said first color to said second color said method further comprises the steps of:

determining a current dye rate for at least one dye used for producing said web having said second color;

combining said nominal dye rate for said at least one dye with said current dye rate for said at least one dye being used for producing said web having said second color to determine a new nominal dye rate for said at least one dye for producing said web having said second color; and saving said new nominal dye rate as said nominal dye rate for said at least one dye for producing said web having said second color.

10. A method as claimed in claim 9 wherein said step of determining a current dye rate comprises the step of taking data representative of said current dye rate after said web changes from said first color to said second color and before said web is changed from said second color to third color.

11. A method as claimed in claim 9 wherein said step of determining a current dye rate comprises the steps of:

accumulating data representative of said current dye rate for said at least one dye used for producing said web having said second color for a period of time after said web changes from said first color to said second color; and averaging said accumulated data to determine said current dye rate.

12. A method as claimed in claim 9 wherein said step of combining said nominal dye rate for said at least one dye with said current dye rate for said at least one dye being used for producing said web having said second color to determine a new nominal dye rate for said at least one dye being used for producing said web having said second color comprises the step of solving the equation:

$$\text{new nominal dye rate}=(\alpha)\text{nominal dye rate}+(1-\alpha)\text{current dye rate},$$

where $0 \leqq \alpha \leqq 1$.

13. A method as claimed in claim 12 wherein $\alpha$ is set equal to a selected value.

14. A method as claimed in claim 13 wherein said selected value is set within a range from about 0.2 to about 0.3.

15. A method as claimed in claim 12 further comprising the step of selecting $\alpha$ based on quality of said web of paper having said first color currently being manufactured and performance parameters of said paper making machine.

16. A method for changing color of a web of paper from a first color to a second color during manufacture of said web, said method comprising the steps of:

operating a paper making machine to produce a web of paper having said first color;

determining a current dye rate for at least one dye during production of said web having said first color;

retrieving a nominal dye rate for at least one dye for producing said web having said second color;

determining a difference between said current dye rate and said nominal dye rate;

using said difference between said current dye rate and said nominal dye rate to change the dye rate for said at least one dye for said second color from said current dye rate to said nominal dye rate to change said web from said first color to said second color by using the following change dye rate equation:

$$ChgDyeRate(s) = \left\{\left[\frac{\tau_1}{\tau_2} - \left(\frac{\tau_1}{\tau_2} - 1\right)\frac{e^{-T_{d2}s}}{\tau_2 s + 1}\right]e^{-T_{d1}s}(\Delta dyerate)\right\}u(s)$$

where time constant $t_1$ is the response time from a change in the dye rate to about 63% of the resulting final web color change, time constant $t_2$ is the desired response time to achieve about 63% of a final web color change, $T_{d1}$ is a time delay for coordinating dye rate change with any other dye rate changes and $T_{d2}$ is a time period for a boost function for the dye rate change before starting said settling time.

17. Apparatus for controlling color change of a web of paper from a first color to a second color during manufacture of said web by a paper making machine, said apparatus comprising:

a dye addition system for adding at least one dye to a web of material being manufactured by said paper making machine; and a controller programmed to perform the operations of:

determining a current dye rate for said at least one dye during production of said web having said first color;

retrieving a nominal dye rate for at least one dye for producing said web to have said second color;

determining a dye rate boost value greater than said nominal dye rate for a dye rate increase and less than said nominal dye rate for a dye rate decrease;

determining a period of time for initially applying said dye rate boost;

determining the difference between said current dye rate and said nominal dye rate; and using said difference between said current dye rate and said nominal dye rate to change the dye rate for said at least one dye for said second color from said current dye rate to said nominal dye rate to change said web from said first color to said second color and initially applying said dye rate boost value for said dye rate boost period of time.

18. Apparatus for controlling color change of a web of paper from a first color to a second color during manufacture of said web by a paper making machine, said apparatus comprising:

a dye addition system for adding at least one dye to a web of material being manufactured by said paper making machine; and a controller programmed to perform the operations of:

determining a current dye rate for said at least one dye during production of said web having said first color;

retrieving a nominal dye rate for at least one dye for producing said web to have said second color;

determining the difference between said current dye rate and said nominal dye rate;

using said difference between said current dye rate and said nominal dye rate to change the dye rate for said at least one dye for said second color from said current dye rate to said nominal dye rate to change said web from said first color to said second color;

wherein said at least one dye for which the current dye rate is determined during production of said web having said first color is used to produce said web having said first color and said controller is further programmed to perform the operations of:

retrieving a nominal dye rate for said at least one dye used for said first color;

combining said nominal dye rate for said at least one dye used for said first color with said current dye rate for said at least one dye for said first color to determine a new nominal dye rate for said at least one dye used for said first color; and saving said new nominal dye rate as said nominal dye rate for said at least one dye being used to produce said web having said first color.

19. Apparatus for controlling color change of a web of paper from a first color to a second color during manufacture of said web by a paper making machine, said apparatus comprising:

a dye addition system for adding at least one dye to a web of material being manufactured by said paper making machine; and a controller programmed to perform the operations of:

determining a current dye rate for said at least one dye during production of said web having said first color;

retrieving a nominal dye rate for at least one dye for producing said web to have said second color;

determining the difference between said current dye rate and said nominal dye rate;

using said difference between said current dye rate and said nominal dye rate to change the dye rate for said at least one dye for said second color from said current dye rate to said nominal dye rate to change said web from said first color to said second color;

wherein after said web changes from said first color to said second color said controller is further programmed to perform the operations of:

determining a current dye rate for at least one dye used for producing said web having said second color;

combining said nominal dye rate for said at least one dye with said current dye rate for said at least one dye used for producing said web having said second color to determine a new nominal dye rate for said at least one dye for producing said web having said second color; and saving said new nominal dye rate as said nominal dye rate for said at least one dye for producing said web having said second color.

20. Apparatus for controlling color change of a web of paper from a first color to a second color during manufacture of said web by a paper making machine, said apparatus comprising:

a dye addition system for adding a plurality of dyes to a web of material being manufactured by said paper making machine; and a controller programmed to perform the operations of:

determining a current dye rate for each of said plurality of dyes for said first color;

retrieving a nominal dye rate for each of said plurality of dyes for said second color;

determining a dye rate boost value greater than said nominal dye rate for a dye rate increase and less than said nominal dye rate for a dye rate decrease for each of said plurality of dyes for said second color;

determining a period of time for initially applying said dye rate boost for each of said plurality of dyes for said second color;

determining differences between said current dye rates and said nominal dye rates for said second color; and using said differences between said current dye rates and said nominal dye rates to change the dye rates for said plurality of dyes for said second color from said current dye rate to said nominal dye rate to change said web from said first color to said second color and initially applying said dye rate boost values for said plurality of dye rate boost periods of time.

* * * * *

UNITED STATES PATENT AND TRADEMARK OFFICE

CERTIFICATE OF CORRECTION

PATENT NO. : 6,584,372 B1
DATED : June 24, 2003
INVENTOR(S) : Timothy F. Murphy

It is certified that error appears in the above-identified patent and that said Letters Patent is hereby corrected as shown below:

Title page,
Item [57], ABSTRACT,
Line 6, "The dry rate change" should read -- The dye rate change --;

$$" DyeRate_i = \frac{(PumpHeadsize_i)(ShaftSpeed_i)(DyeConcentration_i)(DyeDensity_i)(UnitConv)}{ProductionRate} "$$

should read $$-- DyeRate_i = \frac{(PumpHeadsize_i)(ShaftSpeed_j)(DyeConcentration_i)(DyeDensity_i)(UnitConv)}{ProductionRate} --;$$

Column 5,
Line 57, "reflected aroung the" should read -- reflected around the --;

Column 7,
Line 55, "time of initially" should read -- time for initially --;

Column 10,
Line 38, "time constant $t_1$ is" should read -- $\tau_1$ --;
Line 40, "time constant $t_2$ is" should read -- $\tau_2$ --.

Signed and Sealed this

Thirtieth Day of March, 2004

JON W. DUDAS
*Acting Director of the United States Patent and Trademark Office*